US006032726A

United States Patent [19]

Wright et al.

[11] Patent Number: 6,032,726

[45] Date of Patent: Mar. 7, 2000

[54] LOW-COST LIQUID HEAT TRANSFER PLATE AND METHOD OF MANUFACTURING THEREFOR

[75] Inventors: Lloyd F. Wright, Port Ewen, N.Y.; Justice Carman, Valley Center, Calif.

[73] Assignee: Solid State Cooling Systems, Poughkeepsie, N.Y.

[21] Appl. No.: 08/885,022

[22] Filed: Jun. 30, 1997

[51] Int. Cl.[7] ..... F28F 13/12; F28F 3/12

[52] U.S. Cl. ..... 165/109.1; 165/168; 165/133; 165/177; 138/38

[58] Field of Search ..... 165/168, 170, 165/109.1, 181, 133, 177, 179; 138/38

[56] References Cited

U.S. PATENT DOCUMENTS

| | | | |
|---|---|---|---|
| 1,443,189 | 1/1923 | Malm | 165/170 |
| 1,621,742 | 3/1927 | Kessler | 165/168 |
| 1,664,628 | 4/1928 | Kessler | 165/168 |
| 1,818,387 | 8/1931 | Dinzl | 165/168 |
| 1,884,612 | 10/1932 | Dinzl | 165/168 |
| 1,929,824 | 10/1933 | Polley | 165/168 |
| 2,424,612 | 7/1947 | Gunter | 165/179 X |
| 3,676,642 | 7/1972 | Rosen et al. | 165/168 X |
| 3,740,967 | 6/1973 | Huelle | 165/179 X |
| 3,981,356 | 9/1976 | Granetzke | 165/179 |
| 4,658,892 | 4/1987 | Shinohara et al. | 165/133 |
| 4,702,312 | 10/1987 | Brown | 165/179 |
| 4,715,431 | 12/1987 | Schwarz et al. | 165/133 X |

FOREIGN PATENT DOCUMENTS

| | | | |
|---|---|---|---|
| 539529 | 9/1941 | United Kingdom | 165/168 |
| 938888 | 10/1963 | United Kingdom | 165/168 |

*Primary Examiner*—Leonard Leo
*Attorney, Agent, or Firm*—Townsend and Townsend and Crew LLP

[57] ABSTRACT

A process for fabricating a low cost high efficiency liquid cold plate is described. The process uses a metal extrusion designed with internal fluid channels. A simple process for fabricating fluid inlet and outlet manifolds, creating turbulent flow inside the fluid channels, a method for capping the extrusion ends, and a method for improving the surface contact with heat generating components is described.

5 Claims, 3 Drawing Sheets

LOW-COST LIQUID HEAT TRANSFER PLATE AND METHOD OF MANUFACTURING THEREFOR

BACKGROUND OF THE INVENTION

Many types of equipment require some means of temperature control, either by heating or cooling, in order to function effectively. In general, such equipment consists of three elements: the component requiring temperature control, a heat transfer (device, and a medium acting as a thermal energy sink or source. Some equipment, such as those which transfer heat from one medium to another, require heat transfer devices for supplying and removing heat.

In general, equipment which require small amounts of, or low watt-density, cooling use natural or forced convection air cooling. On the other hand, equipment which requires large amounts of, or high watt-density, cooling, or precise temperature control, or operating temperatures at or below ambient air temperature use something other than air for cooling. Such techniques incorporate liquid cooling, thermoelectric cooling, or Freon compressor/condenser cooling.

In the home refrigerator, for example, heat is transferred from the inside of the refrigerator cabinet to the air outside. The refrigeration unit has two heat transfer devices. Inside the refrigerator there is typically an extruded air heat sink and fan which provides forced air convection to remove heat from the source medium, the air inside the refrigerator, and to transfer the heat to the refrigeration unit. Outside the refrigerator, heat from the refrigeration unit is transferred by an external radiator via natural convection into the heat sink medium, i.e., the surrounding air. However, for other applications which require a more efficient thermal energy transport system, liquids can readily provide the medium by which heat is transferred.

The transfer of heat by a liquid medium is often accomplished with a heat transfer plate, sometimes called a "cold plate". A cold plate is typically a flat metal plate in contact with a flowing fluid. Thermally conductive metals, such as aluminum or copper, are commonly used for the plate, although other metals, such as stainless steel, may be used in corrosive environments. Components requiring temperature control are mounted onto an exterior surface of the cold plate.

The thermal efficiency of the cold plate depends upon the amount of surface area of the cold plate in contact with the flowing fluid, the degree of turbulence of the flowing fluid, and the efficiency of thermal contact between the components and the cold plate. It is desirable for a liquid cold plate to have a high degree of thermal efficiency, while at the same time be simple and inexpensive to manufacture. Simple and low-cost manufacturing is commonly achieved with a cold plate formed by a flat aluminum plate with copper tubing glued or pressed into grooves in the surface of the aluminum plate. Such designs have very low surface areas in contact with the flowing fluid. On the other hand, high efficiency heat transfer is commonly achieved with cold plates which have a large amount: of surface area in contact with the cooling fluid. Such cold plates are typically either not flat and complex (e.g., shell and tube designs), or very expensive to manufacture (e.g., brazed plate-fin designs).

Thus the desire for cold plates which are simple and easy-to-manufacture at low costs conflicts with the desire for cold plates with high heat transfer efficiency. However, the present invention resolves these conflicting desires with a cold plate which has high heat transfer, but which is also simple and inexpensive to manufacture.

SUMMARY OF THE INVENTION

The present invention provides for a liquid heat transfer plate which is formed from a unitary plate which has a first surfacer and an opposite second surface, and at least one fluid channel between the first and second surfaces. At least one of the first and second surfaces is leveled. The unitary plate also has first and second ends perpendicular to the fluid channel direction and a first manifold near the first plate end. The manifold is perpendicular to the fluid channel and is fluidly connected to the fluid channel. The plate also has a second manifold near the second plate end perpendicular to the fluid channel and fluidly connected to the fluid channel. First and second caps fixed to the first and second plate ends respectively seal the fluid channel in the plate.

The present invention also provides for a process of manufacturing a heat transfer plate. A preform having first surface and a second surface opposite the first surface and at least one fluid channel in a first direction between said first and second surfaces is first extruded. Then the preform is cut in a second direction perpendicular to the first direction to define a plate having first and second ends. A first manifold is drilled near the first plate end perpendicular to the fluid channel so that the fluid channel is fluidly connected to the first manifold. A second manifold is drilled near the second plate end perpendicular to the fluid channel so that the fluid channel is fluidly connected to the second manifold. First and second caps are fixed to the first and second plate ends respectively to seal the fluid channel in the plate, and at least one of -he first and second surfaces of the plate is leveled.

The resulting heat transfer plate is inexpensive to manufacture, flexible in design, and has high heat transfer performance capabilities.

DETAILED DESCRIPTION OF SPECIFIC EMBODIMENTS

Figure 1:
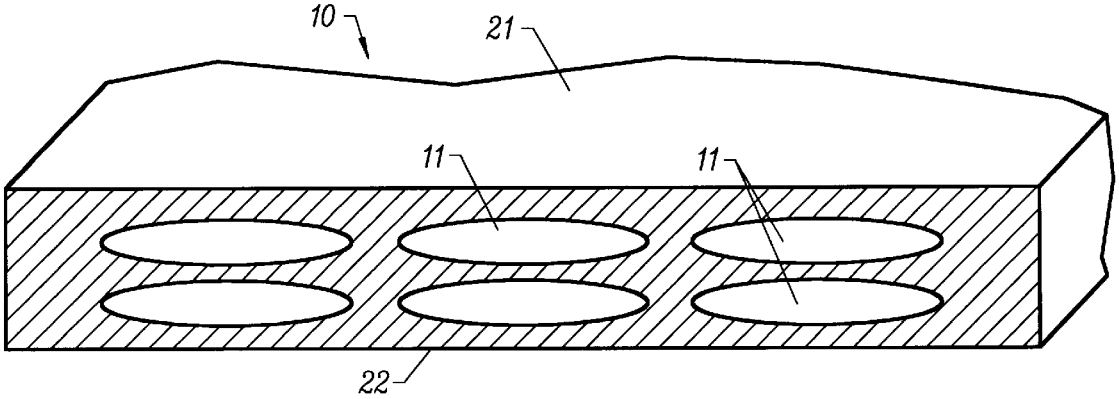
FIG. 1 is a cross-sectional perspective view of an extrusion preform of the heat transfer plate according to an embodiment of the present invention.

The heat transfer plate, i.e., the cold plate, of the present invention starts with an extruded preform 10, as illustrated in FIG. 1. An extrusion die is designed so that the preform 10 has a rectangular shape with cavities 11 in the direction of the extrusion. One or both of the large, flat parallel surfaces 21 and 22 become heat transfer surfaces in the completed heat transfer plate. The cavities 11 extend the length of the extrusion preform 10 and serve as fluid channels for the resulting heat transfer plate. As shown, each of the cavities 11 is elliptical in cross-section, but other cross-sections, such as circular, rectangular, polygonal, and hour-glass shapes, have also be found to be effective. The advantage of elliptical channels is that they facilitate extrusion of the preform 10; the other shapes, while equally effective at heat transfer, raise the costs of the extrusion die and tend to complicate the manufacturing process. Ultimately, manufacturing costs are increased.

Figure 2:
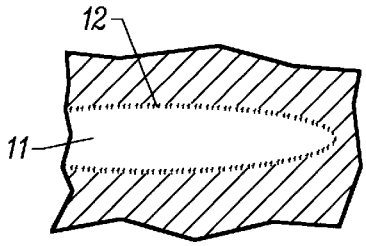
FIG. 2 is a detailed cross-section of one of the fluid channels in the extrusion preform of FIG. 1.

The extrusion die is also designed so that the inner surfaces of the cavities 11 are lined with ridges 12, as shown in the detail of FIG. 2. The ridges 12 increase the surface area of the surfaces of the fluid channels for convective heat transfer to improve the heat transfer plate's efficiency. For example, the ridges 12 with a cross-sectional "saw-tooth" shape, 0.020 inches high and 0.020 inches apart, increase the heat transfer surface area by over a factor of two. Besides the triangular sawtooth shape, the ridges 12 could also have other cross-sectional shapes, such as rectangular, hemispherical an trapezoidal. However, the triangular cross-section of the ridges 12 maximize the heat transfer area without overly complicating the preform extrusion process. During the extrusion process, any small-scale surface features added to the inner surfaces of the fluid channels 11 increase friction between the molten metal and the extrusion die. This slows the rate of extrusion and causes uneven metal flow. The greater the fluid channel surface area, the more friction is created during extrusion. The triangular sawtooth ridges 12 represent a good compromise between increased heat transfer and increased extrusion complexity (and manufacturing costs).

While other metals may be used, it has been found that an extruded aluminum alloy works effectively for the preform 10. The dimensions of the extruded preform 10 is approximately 6 inches across and about an inch thick. Each of the six cavities 11 is approximately 1.5 inches wide and about 0.2 inches high. The particular dimensions of the preform 10 and the locations and design of the cavities are well suited for low-cost manufacturing for the liquid channel elements of a thermoelectric heat exchanger, such as that described in U.S. Pat. No. 5,584,183, which issued Dec. 17, 1996 to Lloyd Wright et al. and is assigned to the present assignee. The described embodiment is also very well suited to withstand the applied clamping pressures which hold the various elements of the thermoelectric heat exchanger together, while maintaining the required heat transfer efficiencies. For other requirements, the other designs for the extruded preform 10 can be easily implemented for low-cost heat transfer plates, according to the present invention.

Figure 3A:
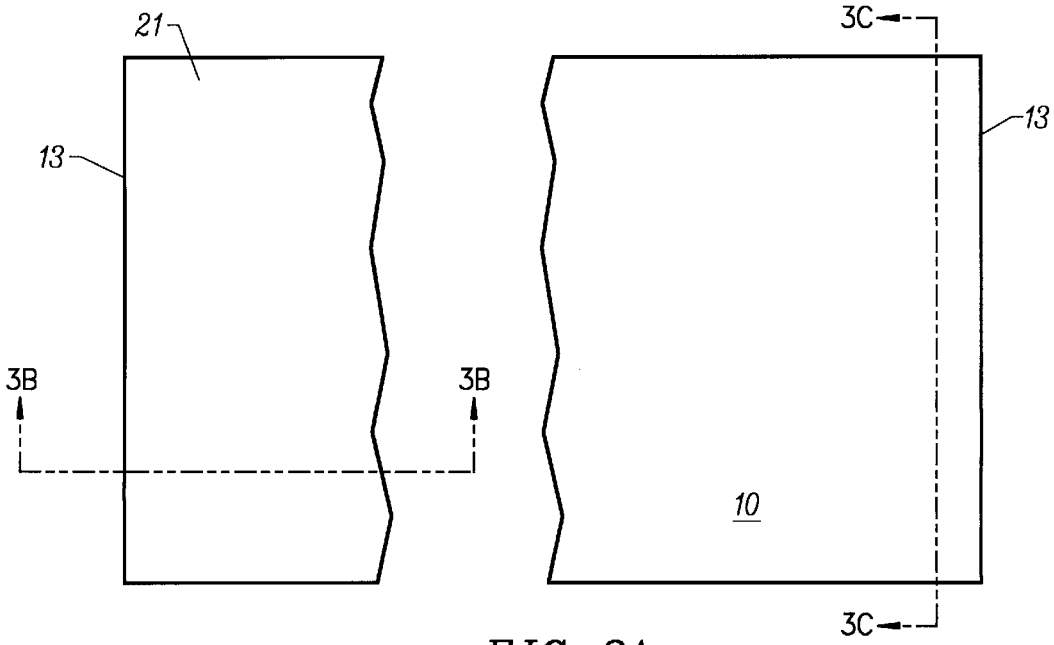
FIG. 3A is a top view of a heat transfer plate formed from the extrusion of FIG. 1.
Figure 3B:
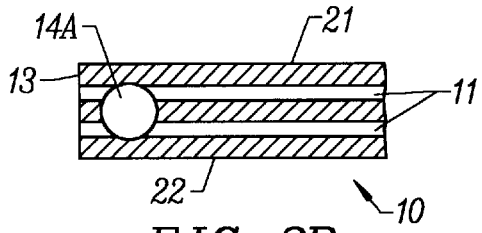
FIG. 3B is a cross-sectional view along line B–B' in FIG. 3A.
Figure 3C:
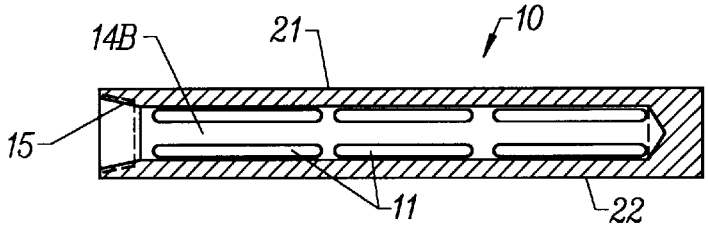
FIG. 3C is a cross-sectional view along line C–C' in FIG. 3A.

The extrusion preform 10 is then cut to the desired length so that the preform 10 has ends 13, as shown in the top view of FIG. 3A. Fluid inlet and outlet manifolds 14A and 14B are drilled near both ends 13 of the extrusion 10 in a direction perpendicular to the internal cavities 11. FIG. 3B, a cross-sectional view along line B–B' in FIG. 3A, illustrates one of the perpendicular holes forming the manifold 14A. The manifold 14A is drilled with a diameter sufficiently large and sufficiently deep into the preform 10 so that all internal cavities 11 are fluidly connected to the drilled fluid manifold 14A. The other fluid manifold 14B is similarly created as illustrated in FIG. 3C, a cross-sectional view along line C–C' in FIG. 3A. FIG. 3C shows that the manifold 14B along its length and its fluid connection to all of the fluid cavities 11.

Figure 3D:
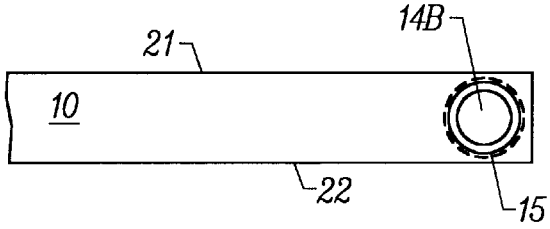
FIG. 3D is an external side view of the heat transfer plate perpendicular to the line C–C' in FIG. 3A.

The fluid manifolds 14A and 14B are sized to match standard drill diameters required for the subsequent tapping of pipe threads at the entrance to each of the holes forming the manifolds 142. and 14B. The standard sizing avoids the need for special tools; and parts. The resulting pipe threads 15 engage fittings to make fluid connections to the manifolds 14A and 14B. The threads 15 of the manifold 14B are illustrated in the cross-sectional side view in FIG. 3C and in the FIG. 3D side view, which Illustrates the entrance to the manifold 14B, in a direction perpendicular to the line C–C' of FIG. 3A.

Figure 4C:
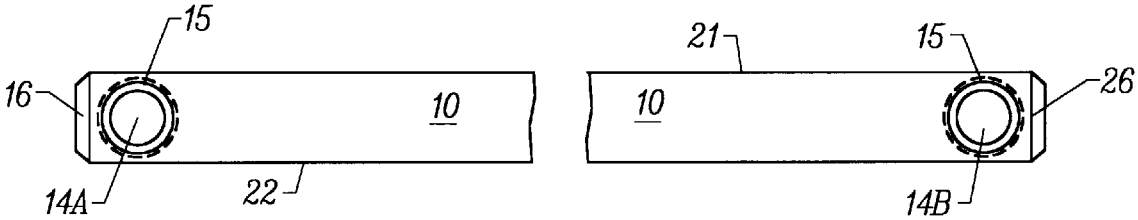
FIG. 4C is a side view of heat transfer plate of FIG. 4A.
Figure 4A:
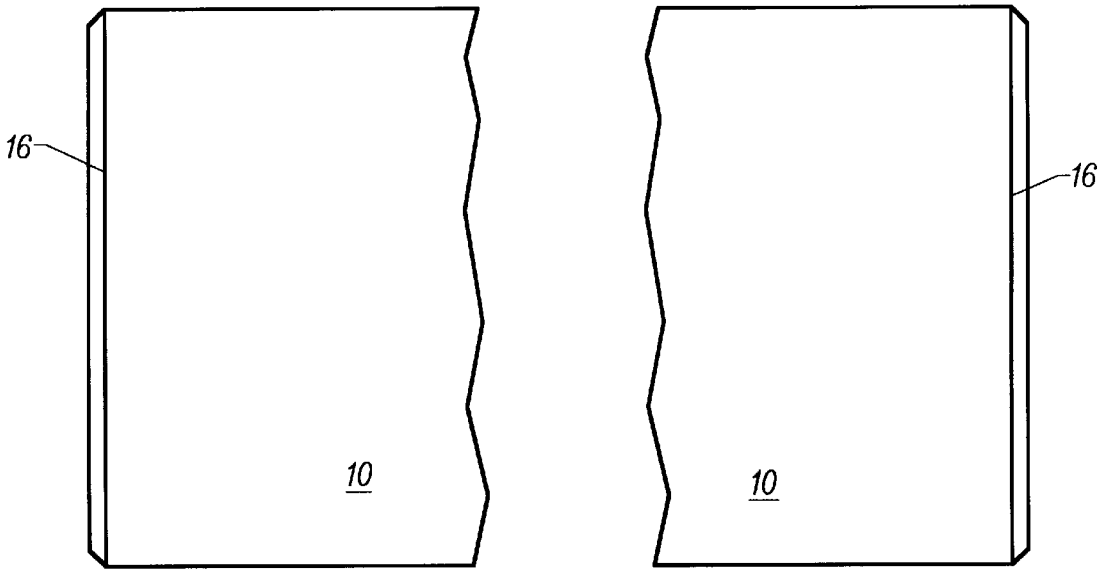
FIG. 4A is a top view of the heat transfer plate with the end caps.
Figure 4B:
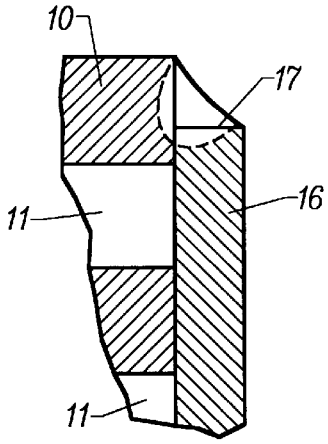
FIG. 4B is a detailed view of one of the end caps of FIG. 4A.

As illustrated in FIG. 4A, cap plates 16 are fixed on each end 13 to seal the internal cavities 11. The cap plates may be welded. FIG. 4B shows a fillet weld 17 at an edge of a cap plate 16 and the end 13 of the preform 10. Full penetration welds for the cap plates 16 create excellent seals against leaks and can withstand very high pressures. Welding is well-characterized and relatively inexpensive. A disadvantage to welding is that upon cooling, the weld tends to warp the preform 10. This requires additional process steps to ensure flatness of the preform surfaces, as discussed below.

Alternatively, the cap plates 16 may be fixed by brazing, soldering, or gluing to the ends 13 of the extrusion preform 10. Brazing provides an excellent high-pressure seal against leaks; however, brazing is more expensive and is more prone, compared to welding, to leave undesirable voids in the sealing surface for leaks. Soldering has the same disadvantages as brazing. Furthermore, soldering with aluminum is very difficult unless the aluminum is coated with zinc, an additional manufacturing expense. Gluing, on the other hand, provides manufacturing at the lowest cost; nonetheless, the glued bonds are weakest compared to the other processes and cannot withstand high pressure. A consistent gluing process is difficult to achieve and hence, the glued bonds are considered the least reliable.

Figure 5:
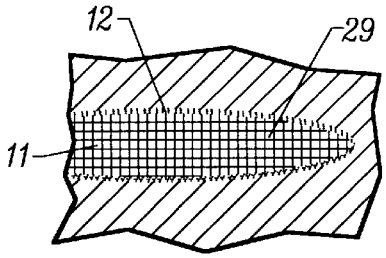
FIG. 5 is a partail cross-sectional of a fluid channel with wire mesh.

Finally, while the surfaces 21 and 22 of the preform 10 are nominally flat, they may not be sufficiently flat enough for optimum heat transfer. Thus one or both of the surfaces 21 and 22 is ground flat as needed before the assembled heat transfer plate is mounted to the heat generating components. Alternatively the surfaces 21 and 22 may be machined or lapped. Furthermore, to improve heat transfer inside the cavities 11 forming the fluid channels of the assembled heat transfer plate, a wire mesh or other such material can be inserted inside the cavities 11 (and manifolds 14A and 14B) to break up laminar flow boundary layers to create turbulent flow. FIG. 5 illustrates a wire mesh 29 inside a cavity 11.

Although the foregoing invention has been described in some detail by way of illustration and example, for purposes of clarity of understanding, it will be obvious that certain changes and modifications may be practiced within the scope of the appended claims.

What is claimed is:

1. A liquid heat transfer plate comprising a unitary, one-piece plate having a first surface and a second surface opposite said first surface and a plurality of fluid channels in a first direction in said plate between said first and second surfaces, said plate having first and second ends perpendicular to said first direction, said fluid channels extending from said first plate end to said second plate end, each of said fluid channels having a serrated surface, at least one of said first and second surfaces having a flat surface;

a wire mesh in each of said fluid channels to increase turbulent flow therein;

a first manifold near said first plate end perpendicular to said fluid channels and fluidly connected thereto;

a second manifold near said second plate end perpendicular to said fluid channels and fluidly connected thereto; and first and second caps fixed to said first and second plate ends respectively, said first cap blocking said fluid channels at said first plate end and said second cap blocking said fluid channels at said second plate end.

2. The liquid heat transfer plate of claim 1 wherein said at least one flat surface comprises a ground flat surface.

3. The liquid heat transfer plate of claim 1 wherein said at least one flat surface comprises a machined flat surface.

4. The liquid heat transfer plate of claim 1 wherein said at least one flat surface comprises a lapped flat surface.

5. The liquid heat transfer plate of claim 1 further comprising a wire mesh in said first and second manifolds respectively.

* * * * *